US012195919B2

(12) United States Patent
Leach et al.

(10) Patent No.: US 12,195,919 B2
(45) Date of Patent: Jan. 14, 2025

(54) MULTI-STEP LOW TEMPERATURE AND LOW PRESSURE PROCESS FOR AGRICULTURAL FEEDSTOCK STOCK PREPARATION WITH HEMICELLULOSE AND LIGNIN RECOVERY

(71) Applicant: KANBOL, INC, Franklin, KY (US)

(72) Inventors: Miles Leach, Franklin, KY (US); Michel McKenzie, Valleyfield (CA)

(73) Assignee: KANBOL, INC., Franklin, KY (US)

( * ) Notice: Subject to any disclaimer, the term of this patent is extended or adjusted under 35 U.S.C. 154(b) by 107 days.

(21) Appl. No.: 17/989,255

(22) Filed: Nov. 17, 2022

(65) Prior Publication Data

US 2023/0151547 A1 May 18, 2023

Related U.S. Application Data

(60) Provisional application No. 63/280,855, filed on Nov. 18, 2021.

(51) Int. Cl.
*D21H 11/12* (2006.01)
*D21C 3/02* (2006.01)
(Continued)

(52) U.S. Cl.
CPC ..... *D21H 11/12* (2013.01); *D21C 3/02* (2013.01); *D21C 3/26* (2013.01); *D21H 11/02* (2013.01); *D21H 11/16* (2013.01)

(58) Field of Classification Search
CPC ..... D21C 3/26; D21H 11/12
See application file for complete search history.

(56) References Cited

U.S. PATENT DOCUMENTS 2,783,146 A * 2/1957 McKee ..... D21C 3/003 162/96
3,313,677 A * 4/1967 Carr ..... D21C 3/26 162/61

(Continued)

FOREIGN PATENT DOCUMENTS

CN 101613728 B 12/2012
CN 105064116 A 11/2015

(Continued)

OTHER PUBLICATIONS

English machine translation WO 200901556 A1, 2009. (Year: 2009).*

(Continued)

*Primary Examiner* — Anthony Calandra
(74) *Attorney, Agent, or Firm* — Workman Nydegger

(57) ABSTRACT

Methods and systems for preparing agricultural residue or other agricultural feedstock for use as a pulp. The method includes providing non-wood agricultural residue (e.g., corn stover) or other agricultural feedstock that includes agricultural fibers, chemically pulping the agricultural fibers in a preliminary alkaline chemical pulping process at a low consistency and at a low temperature to produce partially pulped agricultural fibers, such step including separating lignin and hemicellulose from the partially pulped agricultural fibers, introducing the partially pulped agricultural fibers into a first reactor, wherein the first reactor operates at a low temperature of less than 100° C. (e.g., 65° C.), introducing the agricultural fibers from the first reactor into a second reactor, where the second reactor operates at a low temperature, of less than 100° C. (e.g., 94-96° C.), the second reactor operating at a higher temperature than the first reactor, to produce pulped agricultural fibers.

26 Claims, 5 Drawing Sheets

(51) Int. Cl.

| | |
|---|---|
| ***D21C 3/26*** | (2006.01) |
| ***D21H 11/02*** | (2006.01) |
| ***D21H 11/16*** | (2006.01) |

(56) References Cited

U.S. PATENT DOCUMENTS

| | | | | |
|---|---|---|---|---|
| 6,048,917 | A | 4/2000 | Hammer et al. | |
| 6,302,997 | B1 | 10/2001 | Hurter et al. | |
| 6,379,594 | B1 | 4/2002 | Dopfner et al. | |
| 7,867,358 | B2 | 1/2011 | Medoff | |
| 7,887,672 | B2 * | 2/2011 | Yang | D21C 3/02 162/99 |
| 8,157,955 | B2 * | 4/2012 | Foody, Sr. | B65G 53/40 162/99 |
| 8,303,772 | B2 | 11/2012 | Li et al. | |
| 8,778,135 | B2 | 7/2014 | Li et al. | |
| 9,375,703 | B2 | 6/2016 | Harlin et al. | |
| 9,719,213 | B2 | 8/2017 | Miller, IV et al. | |
| 9,777,429 | B2 * | 10/2017 | Mikulic | D21C 3/18 |
| 9,938,663 | B2 | 4/2018 | Powars | |
| 10,077,531 | B2 | 9/2018 | Schroeder et al. | |
| 10,544,547 | B2 | 1/2020 | Sealey et al. | |
| 10,662,586 | B2 | 5/2020 | Kokko et al. | |
| 2003/0041982 | A1 | 3/2003 | Prior | |
| 2004/0256065 | A1 | 12/2004 | Ahmed et al. | |
| 2006/0201641 | A1 | 9/2006 | Harris et al. | |
| 2007/0095491 | A1 | 5/2007 | Altheimer | |
| 2007/0199669 | A1 | 8/2007 | Yang et al. | |
| 2008/0187735 | A1 | 8/2008 | Hammer et al. | |
| 2014/0205777 | A1 | 7/2014 | Hawkins et al. | |
| 2014/0352903 | A1 | 12/2014 | Ernegg | |
| 2015/0232703 | A1 | 8/2015 | Nelson et al. | |
| 2016/0130762 | A1 | 5/2016 | Ramaratnam et al. | |
| 2016/0257486 | A1 | 9/2016 | Kuiper et al. | |
| 2016/0355444 | A1 | 12/2016 | Olkowski et al. | |
| 2017/0016179 | A1 | 1/2017 | Olkowski et al. | |
| 2017/0328011 | A1 | 11/2017 | Sealey, II et al. | |
| 2018/0134472 | A1 | 5/2018 | Shi et al. | |
| 2018/0299059 | A1 | 10/2018 | McGoff et al. | |
| 2019/0264385 | A1 | 8/2019 | Pauwels et al. | |
| 2019/0284760 | A1 | 9/2019 | Hoekstra et al. | |
| 2019/0390405 | A1 | 12/2019 | Geigle et al. | |
| 2020/0056333 | A1 | 2/2020 | Backfolk et al. | |
| 2020/0189256 | A1 | 6/2020 | Field et al. | |
| 2021/0355636 | A1 | 11/2021 | Mikulic | |
| 2022/0389657 | A1 | 12/2022 | Leach et al. | |

FOREIGN PATENT DOCUMENTS

| | | | | |
|---|---|---|---|---|
| CN | 106012635 | A | 10/2016 | |
| CN | 106012650 | A | 10/2016 | |
| CN | 106087503 | A | 11/2016 | |
| CN | 108589371 | A | 9/2018 | |
| CN | 110318278 | A | 10/2019 | |
| CN | 110700004 | A | 1/2020 | |
| CN | 111691215 | A | 9/2020 | |
| CN | 111691221 | A | 9/2020 | |
| CN | 111996827 | A | 11/2020 | |
| CN | 112176762 | A | 1/2021 | |
| CN | 112813718 | A | 5/2021 | |
| CN | 113106769 | A | 7/2021 | |
| CN | 113265898 | A | 8/2021 | |
| CN | 113389085 | A | 9/2021 | |
| EP | 0743393 | A2 | 11/1996 | |
| EP | 3172378 | B1 | 4/2018 | |
| IN | 219632 | | 10/2007 | |
| KR | 10-2005-0003545 | A | 1/2005 | |
| WO | 2003/025280 | A1 | 3/2003 | |
| WO | 2009/015555 | A1 | 2/2009 | |
| WO | WO-2009015556 | A1 * | 2/2009 | D21C 5/00 |
| WO | 2016/011736 | A1 | 1/2016 | |
| WO | 2016/013946 | A1 | 1/2016 | |
| WO | WO-2016051202 | A1 * | 4/2016 | C07G 1/00 |
| WO | 2019/210221 | A1 | 10/2019 | |
| WO | 2020/048176 | A1 | 3/2020 | |
| WO | 2020/261165 | A1 | 12/2020 | |
| WO | 2022/052775 | A1 | 3/2022 | |

OTHER PUBLICATIONS

Smook, Handbook for Pulp and Paper Technologists, 1992, Angus Wilde Publications, 2nd edition, chapter 9 (Year: 1992).*

Dale R. Sanchez, Recausticizing-Principles and Practice, 2015, Tappi, 30 pages.

Katherine E. Semple et al., Moulded pulp fibers for disposable food packaging: a state-of-the-art review., Aug. 20, 2021, Food Packaging and Shelf Life, 18 pages, vol. 33.

Non-Final Rejection Mailed on Sep. 13, 2023 for U.S. Appl. No. 17/825,964, 13 page(s).

El-Saied et al., "Bagasse semichemical pulp by alkaline hydrogen peroxide treatment", IPPTA Journal, Mar. 2022, vol. 14, No. 1, pp. 14.

Aguilar-Rivera, "Sustainable Sugarcane Bagasse Cellulose for Papermaking", Advanced Engineering Materials and Modeling, Chapter 4, 2016, pp. 121-163.

Cheng et al., "Alkali extraction of hemicellulose from depithed corn stover and effects on soda-AQ pulping," BioRes. 6 (2011), 196-206, 2005. Retrieved at http://ojs.cnr.ncsu.edu/index.php/BioRes/article/viewFile/BioRes_06_1_0196_Cheng_ZFL_Alk_Extrac_Hemicel_Corn_Stover/799.

Delmas, "Vegetal Refining and Agrichemistry," Chem. Eng. Technology, vol. 31, Issue 5, 2008, pp. 792-797.

El-Saied et al., "Bagasse semichemical pulp by alkali treatment", IPPTA vol. 13, No. 4, Dec. 2001, pp. 39-46.

Goel et al., "Switchgrass: a potential pulp fibre source," Pulp and Paper Canada 2000, vol. 101, Issue 6, pp. 41-45.

Gutierrez et al., "Chemical characterization of pitch deposits produced in the manufacturing of high-quality paper pulps from hemp fibers," Bioresource Technology, vol. 96, 2005, pp. 1445-1450.

Kortekaas, "Sequenced Anaerobic-Aerobic Treatment of Hemp Pulping Wastewaters", Waginengen Agricultural University, 1998, Retrieved at https://library.wur.nl/WebQuery/wurpubs/fulltext/193312, Nov. 4, 1998, pp. 153.

Law et al., "Fibre morphology and soda-sulphite pulping of switchgrass," Bioresource Technology, vol. 77, 2001, pp. 1-7.

Mussatto et al., "Lignin recovery from brewer's spent grain black liquor," Carbohydrate Polymers, vol. 70, Issue 2, Sep. 20, 2007, pp. 218-223.

Theng et al., "Fiberboards Made from Corn Stalk Thermomechanical Pulp and Kraft Lignin as a Green Adhesive," BioResources 2017, vol. 12, Issue 2, pp. 2379-2393.

Van der Werf et al., "Quality of hemp (Cannabis sativa L.) stems as a raw material for paper," Industrial Crops and Products, vol. 2, Issue 3, May 1994, pp. 219-227.

Zhai et al., "Ultrastructure and Topochemistry of Delignification in Alkaline Pulping of Wheat Straw," Journal of Wood Chemistry and Technology 1989, 9:3, pp. 387-406.

Final Office Action received for U.S. Appl. No. 17/825,964, mailed on Mar. 29, 2024, 15 pages.

International Search Report from corresponding PCT Application PCT/US2022/072613, mailed Oct. 25, 2022.

International Search Report from corresponding PCT Application PCT/US22/80072, mailed Mar. 31, 2023.

Non-Final Office Action received for U.S. Appl. No. 17/825,964, mailed on Aug. 23, 2024, 18 pages.

* cited by examiner

MULTI-STEP LOW TEMPERATURE AND LOW PRESSURE PROCESS FOR AGRICULTURAL FEEDSTOCK STOCK PREPARATION WITH HEMICELLULOSE AND LIGNIN RECOVERY

CROSS-REFERENCE TO RELATED APPLICATIONS

The present invention claims the benefit under 35 USC 119(e) of U.S. Application No. 63/280,855, filed Nov. 18, 2021, and entitled MULTI-STEP LOW TEMPERATURE AND LOW PRESSURE PROCESS FOR AGRICULTURAL RESIDUE STOCK PREPARATION WITH HEMICELLULOSE AND LIGNIN RECOVERY, which is herein incorporated by reference in its entirety.

FIELD OF THE INVENTION

Example embodiments of the present invention generally involve the production of pulp feedstock, e.g., for subsequent use in the production of molded pulp products, paperboard, cardboard (e.g., corrugated containerboard), or the like (e.g., other papers, packaging, or containers), where the feedstock may include one or more types of agricultural fibers such as corn stover or other non-wood agricultural residues or other agricultural feedstocks.

BACKGROUND

Some recent environmental protection efforts are targeting problems such as global warming due to increased greenhouse gas emissions (GHG). Some studies indicate that approximately 80% of GHGs are attributable to carbon. Forest resources may help to sequester carbon, and thereby reduce GHGs. However, such resources provide a significant amount of material for use in the pulp and paper industry. In order to preserve, if not improve, the ability of forest resources to sequester the carbon found in GHGs, there is a need to exert further efforts to protect forest resources.

Particular focus has been placed on the pulp and paper industry, which has traditionally harvested forest resources in high volumes. The paper recycling industry has continued to grow in recent years, and in a process common to the industry, used pulp and paper fibers can be recovered and used as feedstock for the manufacture of new corrugated containers. This has helped start the industry toward a decrease in forest resource consumption, although there is a significant need for further improvement, such as making use of new or alternative fiber sources.

In addition, traditionally, pulp mills use a high volume of process water during pulp production. For this reason they are typically located near to natural water resources. This has long been restrictive to the site selection of pulp mills. If proximity to large amounts of water were no longer necessary, it would free up alternative locations, such as those which would be most conducive to processing agricultural feedstock. Further, a technology with a closed water loop would be an ideal solution, such as described herein, so that pulp mills can be located in the most geographically advantageous area, with regional proximity to both feedstock supply and end users.

ASPECTS OF SOME EXAMPLE EMBODIMENTS

One aspect of the present invention is directed to a method for preparing agricultural residues or other agricultural feedstock for use as a pulp, where the method would preserve fiber length of pulp fiber in such materials, minimize consumption of caustic, provide a desirable level of freeness (e.g., 200-500 mL CSF), while at the same time minimizing capital investment. For example, it would be beneficial to minimize capital investment if modules commonly used in paper pulp manufacture (e.g., recovery boilers, high energy refining, water treatment plants, etc.) could be avoided, as such components traditionally used in wood pulp manufacture are expensive to build, and consume vast amounts of energy to operate.

An exemplary method of the present invention that achieves such results includes providing non-wood agricultural residue or other agricultural feedstock (e.g., corn stover) that includes agricultural fibers, pulping the agricultural fibers in a preliminary low consistency pulping process at low consistency, and low temperature to produce partially pulped agricultural fibers, such step including preliminary separation of lignin and hemicellulose from the partially pulped agricultural fibers. Such preliminary low consistency pulping module may include a moderate amount of added caustic (NaOH). In an embodiment, the caustic present in the low consistency pulping module may come from the recycled brown or black liquor, from the $2^{nd}$ reactor, which is recirculated to upstream modules in the process. The process also includes introducing the partially pulped agricultural fibers into a first reactor, wherein the first reactor operates at a low temperature of less than 100° C. (e.g., at 65° C.±10° C.), and subsequently introducing the agricultural fibers from the first reactor into a second reactor, where the second reactor operates at a low temperature, also at less than 100° C., but in which the second reactor operates at a higher temperature than the first reactor, to produce pulped agricultural fibers. For example, the second reactor may operate at a temperature of about 95° C. Both reactors may operate under atmospheric pressure (0 prig). For example, one of the difficulties of conventional wood pulping processes is in achieving an effective seal in a horizontal screw digester, where such digester reactor operates at higher temperatures than those described herein, under pressure. The present reactors may be vertical reactors (e.g., upflow or downflow tube reactors), which are significantly less expensive than those typically employed in wood pulp processing. For example, where temperatures over 100° C. with pressurized conditions are employed, damage to fibers occurs when exiting such conditions, and blow tanks, cooling zones, etc. are required when exiting such conditions, which greatly increases costs. The present systems and methods avoid such.

Another aspect of the present invention is directed to an associated system for preparing agricultural residue or other agricultural feedstock for use as a pulp, the system comprising a preliminary low consistency pulping module operating at an elevated but still relatively low temperature (e.g., the same as subsequent reactor 1) to produce partially pulped agricultural fibers, such module providing preliminary separation of lignin and hemicellulose from the partially pulped agricultural fibers. The low consistency pulping module may be diluted with recirculated black liquor, from downstream in the process (part of a desired closed loop). The system also includes a first reactor into which the partially pulped agricultural fibers from the low consistency pulping module are introduced for further pulping, with caustic addition. The caustic in the first reactor may be provided by recirculating the black liquor from the second reactor, to the low consistency pulping module, and/or the first reactor. The first reactor operates at a low temperature of less than 100° C. (e.g., 65° C.±10° C.). The system also includes a second reactor into which the agricultural fibers from the first reactor are introduced for additional pulping, where the second reactor also operates at a low temperature, of less than 100° C. (e.g., about 95° C.). The second reactor may operate at a higher temperature than the first reactor, producing pulped agricultural fibers. The second reactor may otherwise be similar to the first reactor, rather than being in reality a fibrillation/refining step optionally conducted at higher temperature, for a far shorter treatment time (e.g., as described in El-Saied et al., Bagasse Semichemical Pulp by Alkali Treatment, IPPTA, Vol. 13, No. 4, December 2001, pgs. 39-46, herein incorporated by reference in its entirety).

Such a method and system advantageously is capable of achieving pulping without shortening the relatively long fiber lengths of the corn stover or similar agricultural residue or other agricultural feedstock material too much. Higher temperatures, higher pressures, long residence times, fibrillation/refining in a blender, and the like act to break up the fibers, shortening fiber length more than would be desirable. Such a method also serves to preserve a desired freeness level to the pulp, where more severe pulping and other processing conditions would increase the generation of fines, which would decrease freeness (or decrease yield if such fines were removed).

The present method and process rather serves to remove the lignin and hemicellulose from the corn stover or other agricultural residue or other agricultural feedstock, while preserving fiber length, and rendering the pulp fraction of such agricultural residue or other agricultural feedstock material as small bundles of fibers (e.g., 2 to 20, 5 to 20, 2 to 10, or 2 to 3 fibers per bundle) rather than separating each fiber individually (which would require more caustic consumption, would further reduce fiber length, increase energy consumption, and reduce freeness and/or yield).

Another benefit of processing according to the relatively gentle low temperature, low caustic conditions described herein, specifically with respect to corn stover, is that more extreme processing conditions result in release of silicates that are stored within corn stover (silicates may similarly be stored within other agricultural residues or other agricultural feedstock as well). Such silicates are actually stored within the growth structures of the corn stover materials (stalks, leaves, cobs, etc.), not simply as silica dust materials that could be removed by washing. For example, corn stover may include about 3% silicates by weight, which can be problematic. While more extreme conditions such as those used in more conventional pulp processing result in dissolution of such silicates into the process water, and subsequent precipitation onto tubing, valve surfaces, and other working surfaces of the system, the presently described relatively gentle conditions do not exhibit such disadvantages that would result in silicate contamination of system surfaces. Such is an important advantage of the present systems and methods, as such silicate precipitates are difficult (if not impossible as a practical matter) to remove, and they interfere with efficient operation of the system.

Preservation of a freeness value in the range of 200-500 mL CSF or 200-450 mL CSF, a high yield (e.g., at least 65%), and preservation of significant fiber length are also important advantages of the present processes and methods. For example, while hardwood pulps may often have very short fibers (e.g., 0.8 mm on average), corn stover can provide significantly longer fiber length, e.g., greater than 0.85 mm, at least 0.9 mm, greater than 1 mm, 0.9 to 3 mm, 0.9 to 2 mm, 0.9 to 1.7 mm, or 1.1 to 1.4 mm on average. Such average lengths are typically based on the weight distribution of fibers in a given pulp sample, such that the average is a weight-based average length, rather than a number-based average length. The increased fiber lengths can aid in delivering enhanced strength to a molded pulp product, liner or corrugated medium, or corrugated container formed from such materials, as compared to shorter fiber lengths. Where a shorter fiber length is desired for feeding into a paper making machine, e.g., where there may be concerns with plugging of the headbox screen or the like, the present methods and processes can accommodate mechanical cutting of such fibers, if needed. For example, the present invention operates on the principle that it is better to preserve fiber length, where possible, and to reduce fiber length after pulping (e.g., after removal of the caustic from the fibers), where a shorter length may be desired.

The present systems and methods advantageously do not employ typical processes or equipment typically employed in the paper/pulp manufacturing field, as such processes and equipment are relatively expensive, requiring a very high capital investment, and result in undesirable production of large quantities of black liquor waste product streams that require significant and expensive treatment, prior to disposal. The present processes and systems, on the other hand, are specifically designed to employ relatively simple, low cost components and processes, which operate under relatively low temperature and low pressure conditions, to minimize the production of such black liquor waste product streams while also preserving high freeness, and fiber length. The present process similarly does not employ steps that would consume large amounts of electrical or other energy (e.g., as in a blender or high energy consumption refiner). The waste product streams generated by the present methods and processes are more environmentally "friendly", so as to require less clean up and treatment of waste streams, so as to make the incorporation of corn stover or other agricultural residue or other agricultural feedstock materials into a pulp blend far more viable from a commercial perspective.

In an embodiment, the pulped agricultural fibers are present as fiber bundles of a plurality of fibers, such as from 2 to 10 fibers.

While corn stover is an exemplary non-wood agricultural residue that may be used in the method and system, a variety of other agricultural residues or other agricultural feedstock are also or alternatively possible, examples of which include, but are not limited to hemp, wheat straw, rice straw, soybean residue, cotton residue, switchgrass, miscanthus, distillers dried grains w/solubles "DDGS", bamboo, or sugarcane bagasse. In an embodiment, the employed agricultural feedstock material is an annual growth plant, which is typically more easily processed in the current methods, than perennial growth plants (e.g., such as bagasse).

In an embodiment, the first reactor operates at a temperature in a range of 40° C. to 80° C., 50° C. to 75° C., or from 60° C. to 70° C. (e.g., 65° C.±10° C.). The second reactor may operate at a temperature in a range of 85° C. to 99° C., from 90° C. to 98° C., or from 90° C. to 96° C., such as about 95° C. By way of further example, the temperature in the second reactor may be at least 10° C. higher, at least 20° C. higher, or at least 25° C. than the temperature of the first reactor.

In an embodiment, the preliminary low consistency pulping process or module operates at a temperature in a range of 40° C. to 80° C. This module may be at the same temperature ranges (or the same temperature) as described relative to the first reactor. In an embodiment, the preliminary low consistency pulping process may have a residence time of less than 30 minutes, less than 20 minutes, less than 15 minutes, or less than 10 minutes (e.g., 8 minutes).

In an embodiment, the first reactor has a residence time of at least 1 hour, such as 1 to 3 hours (e.g., 2 hours). In an embodiment, the second reactor has a residence time of at least 30 minutes, or at least 1 hour, such as 1 to 2 hours (e.g., 1.5 hours). Residence time in the second reactor may be shorter than the residence time in the first reactor.

In an embodiment, the preliminary low consistency pulping process, the first reactor, and the second reactor operate at atmospheric pressure. In an embodiment, no portion of the process may be performed under a pressurized atmosphere.

In an embodiment, the preliminary low consistency pulping process and the first reactor operate at a consistency of less than 5%. In an embodiment, the second reactor operates at a consistency of at least 5%. By way of example, the second reactor may operate at a consistency of 5-6%. The first reactor and the low consistency pulping process may operate at a consistency of 4%.

In an embodiment, the preliminary low consistency pulping process and the first reactor operate at a ratio of caustic to corn stover or other agricultural residue or other agricultural feedstock that is from 4 to 12%, or 5 to 12% (e.g., 8%).

In an embodiment, the second reactor operates at a ratio of caustic to air dry corn stover or other agricultural residue or other agricultural feedstock that is from 8 to 15%, or 10 to 15% (e.g., 12%). In an embodiment, during steady state operation of a continuous process, the caustic addition may occur only at or just before the second reactor. For example, fresh caustic may not be added to the first reactor or the low consistency pulping module.

In an embodiment, no refining or high energy consumption mechanical cutting, blending, etc. of the fibers occurs in the preliminary low consistency pulping module, or reactors 1 and 2. In an embodiment, gentle mixing may be provided, if desired (rather than aggressive mechanical blending or cutting).

In an embodiment, the yield of the pulped agricultural fibers as compared to the agricultural fibers introduced to the preliminary alkaline chemical pulping process or module is at least 40%, at least 50%, at least 60%, or at least 65%, by weight.

In an embodiment, the method is performed without the use of ozone, acids (particularly strong mineral acids, such as hydrochloric acid, sulfuric acid, nitric acid, or phosphoric acid), bleaches (e.g., peroxides or hypochlorites), or other components often used in pulp processing. The addition of caustic (NaOH) may be the only chemical used in producing the pulp. $CO_2$, acetic acid, and/or ethanol may be used in a lignin and/or hemicellulose recover module portion of the system, to precipitate or separate such components from the liquor generated from pulping.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The appended drawings contain figures of example embodiments to further illustrate and clarify the above and other aspects, advantages and features of the present invention. It will be appreciated that these drawings depict only example embodiments of the invention and are not intended to limit its scope. The invention will be described and explained with additional specificity and detail through the use of the accompanying drawings.

DETAILED DESCRIPTION

I. Definitions

Figure 1:
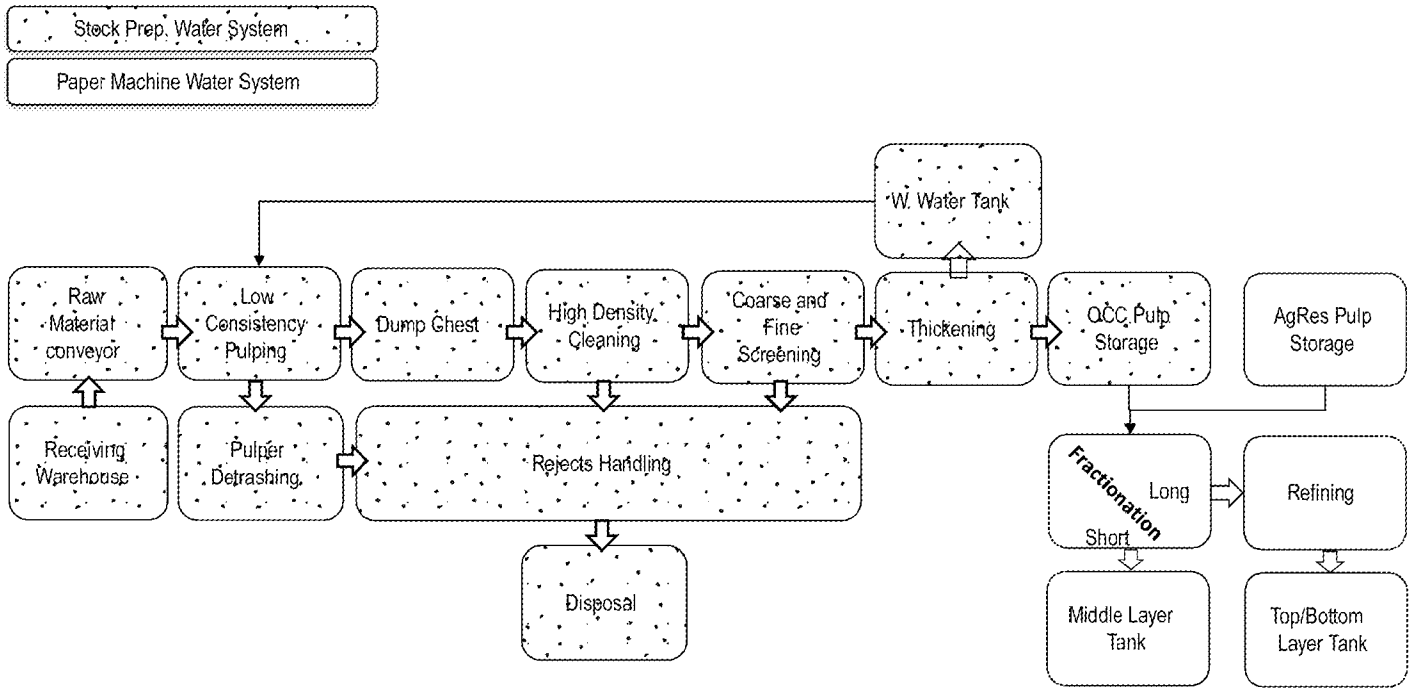
FIG. 1 is a flow chart of an example production process for producing OCC fibers.

Some ranges may be disclosed herein. Additional ranges may be defined between any values disclosed herein as being exemplary of a particular parameter. All such ranges are contemplated and within the scope of the present disclosure.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values for example thus include values that are within 10%, within 5%, within 1%, etc. of a stated value.

All numbers used in the specification and claims are to be understood as being modified in all instances by the term "about", unless otherwise indicated. Notwithstanding that the numerical ranges and parameters setting forth the broad scope of the subject matter presented herein are approximations, the numerical values set forth in the specific examples are reported as precisely as possible. Any numerical value, however, inherently contains certain errors necessarily resulting from the standard deviation found in their respective testing measurements.

Unless otherwise stated, all percentages are by weight.

It must be noted that, as used in this specification and the appended claims, the singular forms "a," "an" and "the" include plural referents unless the content clearly dictates otherwise.

Any directions or reference frames in the description are merely relative directions (or movements). For example, any references to "top", "bottom", "up" "down", "above", "below" or the like are merely descriptive of the relative position or movement of the related elements as shown, and it will be understood that these may change as the structure is rotated, moved, the perspective changes, etc.

All publications, patents and patent applications cited herein, whether supra or infra, are hereby incorporated by reference in their entirety to the same extent as if each individual publication, patent or patent application was specifically and individually indicated to be incorporated by reference.

II. Introduction

While some art exists that teaches use of agricultural residue or other agricultural feedstock materials in preparation of pulp, e.g., for use in papermaking (e.g., U.S. Pat. No. 6,302,997 to Hurter), such references require various process steps that require very high capital expense (akin to that of a wood pulp mill), and operate at conditions that generate waste streams that require expensive treatment before such waste streams can be safely disposed of. For example, such references teach high temperature, high pressure digestion, followed by acidification, bleaching, ozone treatment, and similar chemically and energy intensive processes that require high capital expense, and expensive treatment of generated black liquor or other toxic waste streams. For example, Hurter relies on pressurized cooking (which then requires an expensive cold blow discharge tank), acidification of the pulp, and treatment with ozone and bleaching solutions. Such processes are complex and expensive. An aspect of the present invention is to provide an alternative process that would be far simpler and less expensive, and would not expose the material being pulped to high temperatures, pressures, or to such acids, ozone, bleaching agents, etc. In contrast to a typical copy paper process, there is typically no need for any acid treatments, oxidation (e.g., ozone) or bleaching treatments for the pulp, as well as other processes that require relatively high whiteness or brightness.

Several other references also suggest use of non-wood materials for use in papermaking, e.g., U.S. Pat. No. 8,303,772 to Li, US 2004/0256065 to Ahmed, US 2007/0095491 to Altheimer, WO 2006/132462 to Ryu, and CN 111691221 to Liu, although each of these references performs cooking at high temperature, far in excess of 100° C. (e.g., 140° C.-170° C.), with problems attendant thereto, as described herein, and in Applicant's patent application Ser. No. 17/825,964, filed May 26, 2022, entitled SYSTEM AND METHOD FOR REFINING AGRICULTURAL FIBERS TO A PULP SPECIFICATION, which is herein incorporated by reference in its entirety. Additional references, e.g., CN 106012635 to Feng, CN 106012650 to Yang, CN113265898 to Wang, CN 112176762 to Luan, and CN 113389085 to Wang each rely on use of enzymatic treatment of the non-wood material. The presently contemplated processes differ from such in that enzymes are destroyed at temperatures of greater than 60° C., or greater than 70° C. (where the present processes operate), and use of enzymes in processes as described in such references is very expensive, not suitable for a process intended to produce an alternative pulp material, to be commercially competitive with OCC pulp. Another exemplary reference is U.S. Pat. No. 9,908,680 to Shi, which employs red algae and similar seaweed non-wood pulp materials, precisely because such materials do not include lignin. The present processes are directed to solutions for non-wood pulp materials that do in fact include lignin which needs to be removed (e.g., such as corn stover). In addition, although Shi may describe manufacture of paper products including a blend of such seaweed pulp with wheat straw or corn stover pulp, there is no teaching or suggestion of a low temperature, low pressure, simple and inexpensive process that could be used to produce non-wood pulp materials that might be comparable in cost to low cost alternatives, such as OCC. In an embodiment, the present systems and methods do not employ seaweed, algae or similar marine feedstocks.

El Saied et al., Bagasse Semichemical Pulp by Alkali Treatment, IPPTA, Vol. 13, No. 4, December 2001, pgs. 39-46 describes lab scale work done on bagasse, to prepare it for papermaking. The bagasse was depithed (which is another step, increasing expense), of a perennial growth material. While depithed and/or perennial growth materials may be used in the present processes in some embodiments, depithing is not required, and the present processes are particularly well suited for use with annual growth materials, such as corn stover, or other annual crops. In addition, while El Saied may treat with sodium hydroxide at 90° C., and then transfer the treated material to a laboratory blender for refining/fibrillation, where additional hot water could be added, El Saied does not really teach the use of 2 separate reactors, operated as described herein (e.g., with removal of liquid between the $1^{st}$ and $2^{nd}$ reactors, etc.). The liquor ratio of 6:1 used in El Saied is also significantly thicker than a ratio as contemplated for use in the present processes (e.g., closer to 20:1—far more dilute). The more dilute ratio is less dangerous, and provides for better distribution of caustic into the agricultural feedstock material, to separate fibers or fiber bundles. Furthermore, while a refining step in in a lab blender as in El Saied may be fine for lab scale work, such a step on a commercial scale would require enormous energy input, making the process economically non-viable. The present processes minimize energy consumption, minimize water usage (and use a closed loop to recycle such water), and make the most efficient use of a small amount of caustic (which is countercurrent recycled through the system), to provide a process and system that can produce non-wood pulp fibers at a cost competitive to OCC.

The present systems and methods advantageously do not employ typical processes or equipment typically employed in the paper/pulp manufacturing field, but are specifically designed to employ relatively simple, low cost components and processes, which importantly operate under relatively low temperature and low pressure conditions, to minimize the production of such black liquor waste product streams. Avoiding high temperature and high pressure conditions in some embodiments can be important, even critical, to the success of the present methods, as the avoidance of such conditions ensures that the "toxic soup" black liquor generated as a waste product stream does not develop to the same degree, in the present systems and methods. As noted herein, the presently described conditions also serve to preserve fiber length, minimize silicate precipitate formation, preserve freeness, and maintain high yield. In other words, the waste product streams generated by the present methods and processes are more environmentally "friendly", so as to require less clean up and treatment of waste streams, while at the same time still providing desired separation of lignin and hemicellulose from the agricultural residue or other agricultural feedstock, and the formation of fibers or small bundles of fibers that can be used in manufacture of liner, corrugated medium, cardboard containers, and the like. The present processes and systems make the incorporation of corn stover, other agricultural residue or other agricultural feedstock materials into a pulp blend far more viable from a commercial perspective.

In one embodiment, the present invention is directed to a method for preparing agricultural residue or other agricultural feedstock for use as a pulp, the method comprising providing non-wood agricultural residue (e.g., corn stover) or other agricultural feedstock that includes agricultural fibers, pulping the agricultural fibers in a preliminary low consistency pulping process that operates at low, but still slightly elevated temperature to produce partially pulped agricultural fibers, such step including preliminary separation of lignin and hemicellulose from the partially pulped agricultural fibers. A moderate amount of caustic may be added or present in this step. Importantly, this step does not occur under pressure, and the temperature, while elevated above ambient temperature (e.g., 20-25° C.) is maintained below 100° C., such as 60° C. to 70° C. (e.g., 65° C.). The low temperature and low pressure conditions minimize formation of toxic waste products, which occurs under superficially similar appearing processes, at higher temperatures and pressures, particularly with addition of more chemicals.

The process also includes introducing the partially pulped agricultural fibers into a first reactor, wherein the first reactor operates at a similarly low temperature of less than 100° C. (e.g., 60° C. to 70° C., such as 65° C.), at no applied pressure (i.e., 0 psig), and subsequently introducing the agricultural fibers from the first reactor into a second reactor, where the second reactor operates at a low temperature, also at less than 100° C., the second reactor operating at a somewhat higher temperature than the first reactor (e.g., 85° C. to 99° C.), to produce pulped agricultural fibers. Importantly, the second reactor also operates at no applied pressure (0 psig). The relatively low overall temperatures, and low pressures, as well as appropriate residence times (e.g., no more than 2-3 hours per reactor) minimize the formation of a wide variety of toxic byproducts, that are produced in superficially similar appearing processes, that operate at higher temperature, pressure, chemical addition, and/or residence time.

III. Exemplary Methods and Systems

FIG. 1 shows an exemplary process for preparing old corrugated containers (OCC) pulp, e.g., from recycled cardboard. Such a process is simply shown because in an embodiment, the pulp used to produce new product (e.g., liner, corrugated medium, etc.) may comprise a blend of wood pulp fibers (e.g., OCC pulp) in combination with the agricultural residue or other agricultural feedstock fibers, produced according to the methods described herein. In an embodiment, any such OCC stock preparation may be done in a conventional manner. By way of example, the OCC stock preparation method shown in FIG. 1 includes modules or steps as shown, e.g., where feedstock material is delivered from a receiving warehouse to the raw material conveyor, and from there to a low consistency pulping module. The low consistency pulping module may have a relatively low consistency, e.g. less than 10%, less than 8%, less than 6%, or less than 5% consistency. The consistency may be at least 1%, at least 2%, or at least 3%, such as 4%. Consistency refers to the weight percent of solids in the system module. Retention time in the low consistency pulping module may be less than 20 minutes, less than 15 minutes, or less than 10 minutes, such as at least 3 minutes, or at least 5 minutes, such as 8 minutes. The temperature of the low consistency pulping module may be less than 60° C., less than 50° C., or less than 45° C., such as at least 30° C. or at least 35° C., such as 40° C. No caustic may be added to the low consistency pulping module of FIG. 1.

Trash (e.g., sticker label residue, and other foreign material, that is not pulp fibers) can be removed, if needed, in a pulper detrashing module, although such a module is unlikely to be needed. Trash from such modules can proceed through the rejects handling module, to disposal, as shown in FIG. 1. OCC pulp from the low consistency pulping module can proceed to the dump chest, and if needed, through a high density cleaning module, and a coarse and fine screening module (for fractionation), to a thickening module. The high density cleaning and fine screening modules can be present if needed, although they are likely unnecessary when processing typical OCC for reuse as pulp to produce new liner, corrugated medium, or cardboard containers.

The thickening module may be provided if fine screens (e.g., in the coarse and fine screening module) are used to remove fines from the pulp. If fines are allowed to remain, no thickening may be needed (as the fines may actually provide this function). The pulp may then proceed to the OCC pulp storage module, for mixing with agricultural residue pulp or other agricultural feedstock pulp from the agricultural pulp storage module, as shown, before proceeding to the fractionation module, which separates long and short pulp fibers. The long fiber fraction can be sent to a refining module, after which it proceeds to the top/bottom layer tank, while the short fraction is sent to the middle layer tank. The fractionation module may include slots sized less than 1 mm, less than 0.5 mm, less than 0.3 mm, and greater than 0.05 mm, greater than 0.1 mm, such as 0.15 mm. These values may be for diameters, not fiber lengths, as the fractionation screens or baskets may allow for any fiber length to pass, so long as the fiber diameter requirements are met. Fractionation may be such that about ⅓ of the material is fractionated or sorted as "short", while ⅔ of the material is fractionated or sorted as "long". More generally, the short fraction may be from 25% to 50%, or from 30% to 35% of the total, while the long fraction may be from 50% to 75%, or from 65% to 70% of the total. Some such details of the OCC processing may not be conventional.

Figure 2A:
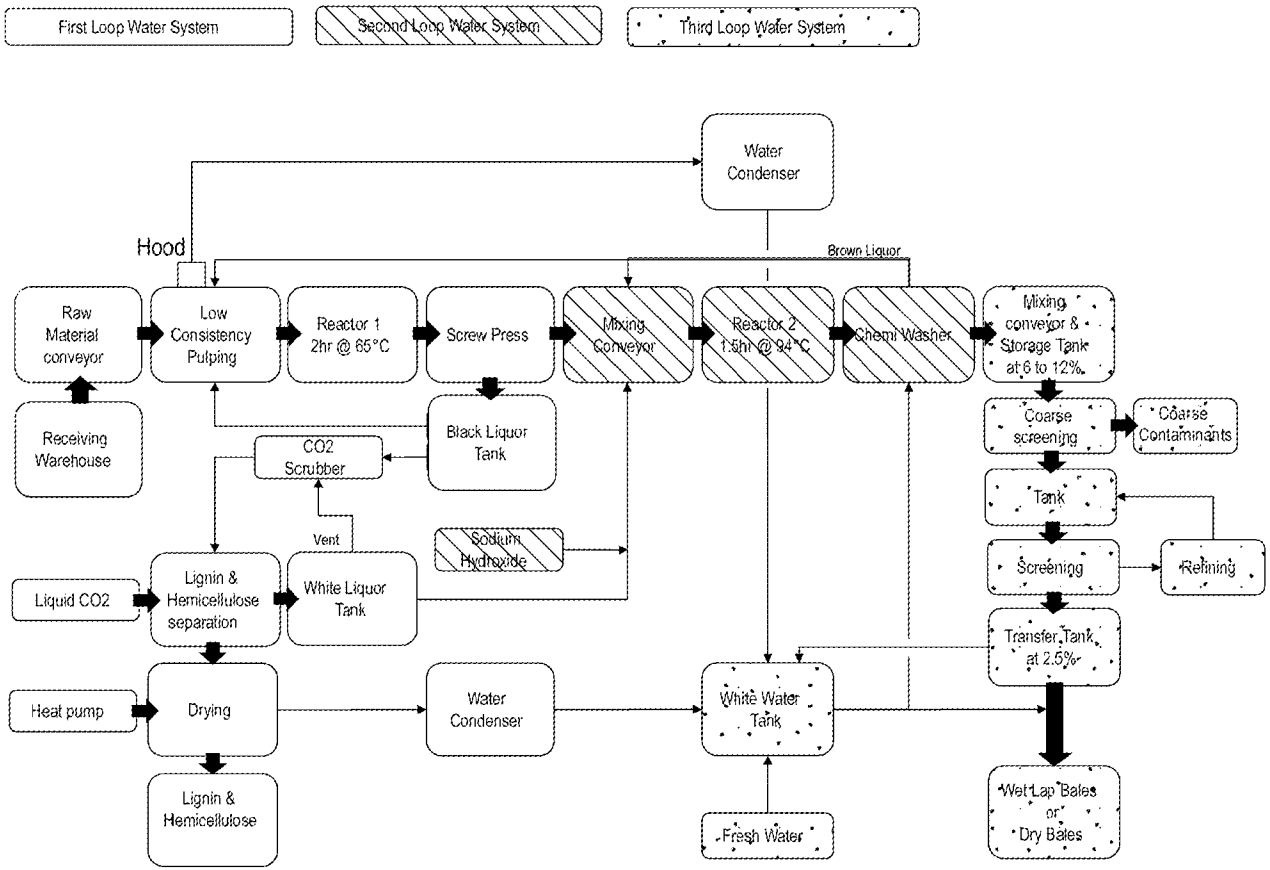
FIGS. 2A-2B are flow charts of example production processes according to various exemplary embodiments of the invention.
Figure 2B:
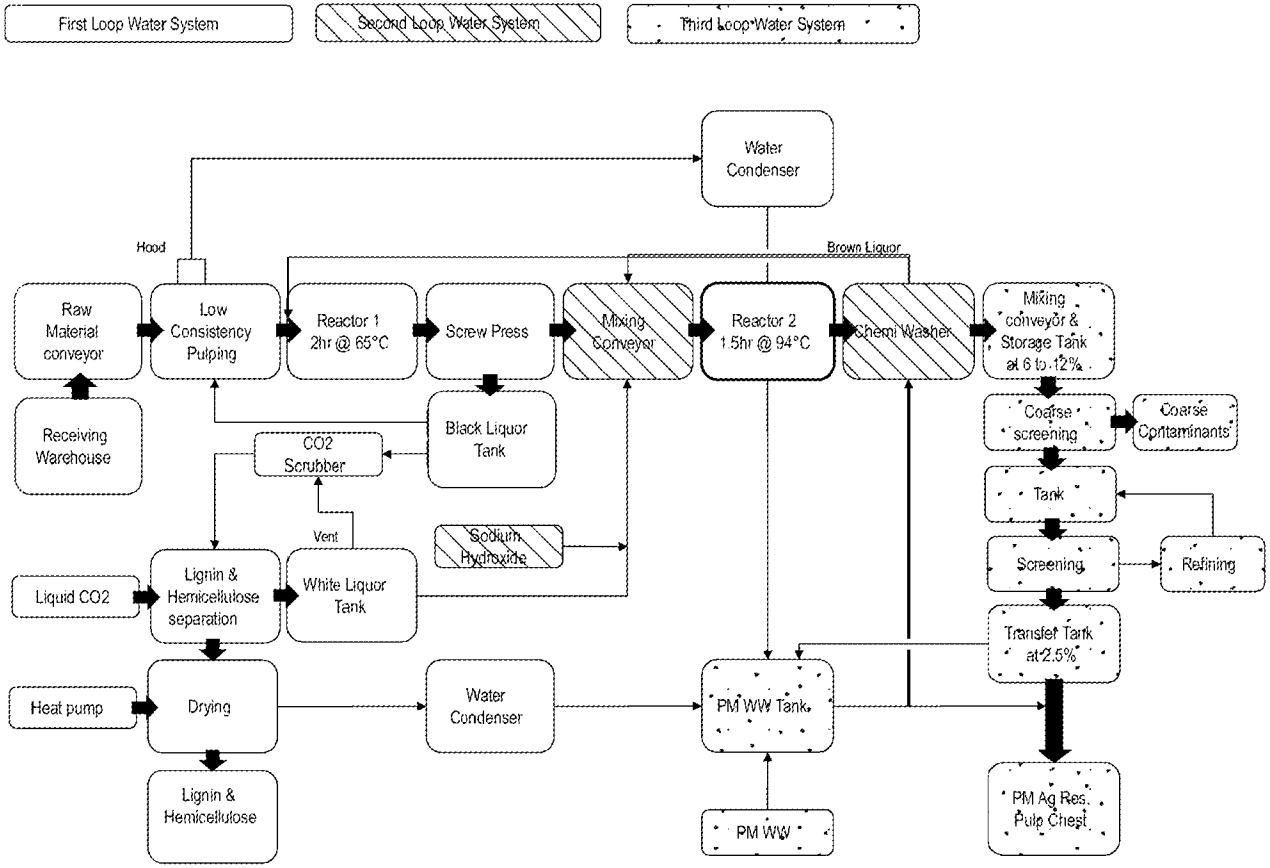

FIGS. 2A-2B illustrate exemplary systems and processes for preparing agricultural residue or other agricultural feedstock for use as a pulp, using principles as described herein (e.g., low temperature, low pressure, conservative use of caustic, minimization of generation of toxic byproducts in the liquor, etc). Agricultural residue or other agricultural feedstock material (e.g., corn stover) is delivered from a receiving warehouse to the raw material conveyor, and from there to the low consistency pulping module (separate from the low consistency pulping module of the OCC process shown in FIG. 1, although it may be similarly configured). The low consistency pulping module of the agricultural residue or other agricultural feedstock preparation process may have similar consistency and residence time characteristics, but may differ in other operational respects (e.g., temperature).

For example, the low consistency pulping module of FIGS. 2A-2B may similarly operate at a relatively low consistency, e.g. less than 10%, less than 8%, less than 6%, or no more than 5% consistency. The consistency may be at least 1%, at least 2%, or at least 3%, such as 4%. Retention time in the low consistency pulping module of FIGS. 2A-2B may similarly be less than 20 minutes, less than 15 minutes, or less than 10 minutes, such as at least 3 minutes, or at least 5 minutes, such as 8 minutes. The temperature of the low consistency pulping module may be less than 100° C., less than 80° C., or less than 70° C., such as at least 30° C. at least 40° C., or at least 50° C., such as 50° C.-70° C., or 60° C. to 70° C. (such as 65° C.).

The low consistency pulping module of FIGS. 2A-2B includes caustic (e.g., NaOH), which serves to begin separating the lignin and hemicellulose from the pulp fibers. The loading of caustic in the low consistency pulping module of FIGS. 2A-2B may be relatively low, such as less than 20%, less than 15%, less than 10%, at least 4%, at least 5%, or at least 6%, such as 8% by mass relative to the corn stover or other agricultural residue or other agricultural feedstock material introduced into such module. Lignin and hemicellulose that is separated from the fibers of the agricultural residue or other agricultural feedstock during the short soak at elevated temperature in the low consistency pulping module of FIGS. 2A-2B can be sent to the lignin and hemicellulose separation module, where it may eventually be recovered through precipitation or extraction using $CO_2$ (e.g., liquid $CO_2$), acetic acid, and/or ethanol, as shown in FIGS. 2A-2B. Recovered hemicellulose or lignin products can eventually be dried, as shown, to provide hemicellulose and/or lignin value added products, in an embodiment. In another embodiment, where no particular market for such materials may be present, the lignin and/or hemicellulose can simply be burned, e.g., providing a fuel source for heating the various reactors of the systems of FIGS. 2A-2B, for example. In an embodiment, such hemicellulose and/or lignin can be mixed with starch, and used as a coating layer on manufactured liner, providing increased strength and hydrophobicity (i.e., water barrier) to such a layer or material. In another embodiment, lignin can be a value added product, e.g., for use in manufacture of a desired plant-based resin material.

Removal of the lignin and hemicellulose from the pulp as quickly as possible, e.g., which is aided by inclusion of 3 modules (low consistency pulping, reactor 1, reactor 2) which perform such is beneficial in preserving and minimizing caustic consumption, as caustic in the presence of lignin (or hemicellulose) will continue to be consumed. It is therefore beneficial to remove and separate the lignin and hemicellulose from the pulp structures as quickly as possible, to maximize efficient use of the caustic material.

The low consistency pulping module may not operate as a pulper in the traditional sense, as it does not actually produce a pulp, but a material that requires further processing, to actually be considered a pulp (e.g., in reactors 1 and 2). Rather, this preliminary module serves to condition the corn stover, other agricultural residue material or other agricultural feedstock, shredding it to a smaller size (although still relatively large), creating a slurry in which the corn stover or similar material is shredded, and wetted, e.g., with average fragments being reduced in length or other size dimension to perhaps 0.5 to 1.5 inch (1.3 to 3.8 cm), creating a slurry having a consistency that is pumpable through the remainder of the system. As some caustic is present in this module, a significant portion of the "fast" lignin, that portion which is most easily extracted, can be extracted from the corn stover in this stage of the process as well. Desired operation of the low consistency pulping module can be adjusted by adjusting various parameters for components of this module, such as extraction plate hole size or shape, density of holes in the plate, the gap between the plate and the rotor, as well as other parameters that effect the degree of shredding, how much lignin is extracted, and the like.

Figure 3:
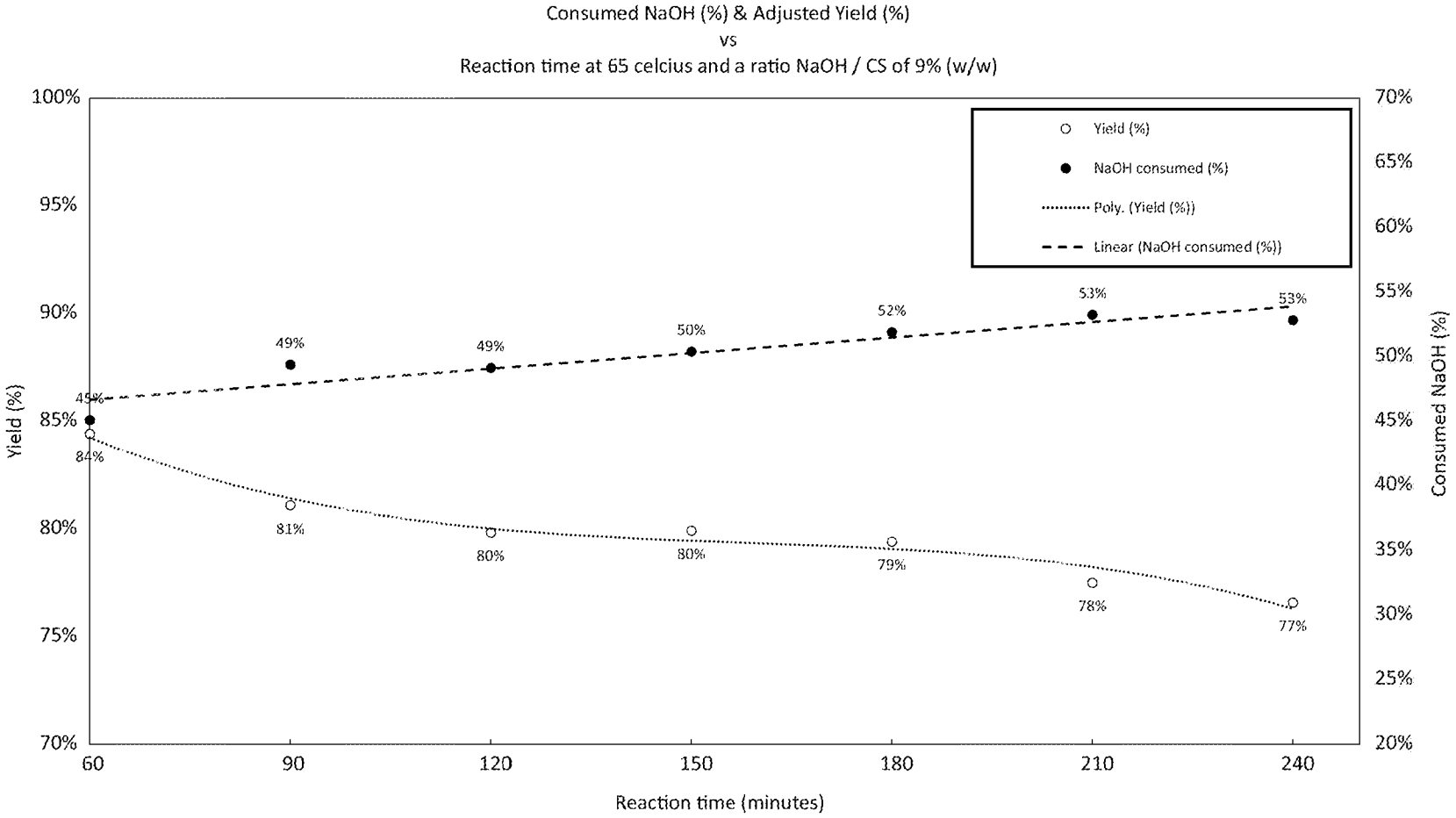
FIG. 3 shows yield and NaOH consumption for various reaction times at a reaction temperature of 65° C., exemplary of conditions in reactor 1 in an exemplary embodiment of the present invention.

The pulp materials separated from the lignin and hemicellulose can be fed into reactor module 1, as shown in FIGS. 2A-2B, for further dissolution of lignin/hemicellulose, and further refining of the pulp fiber component of the corn stover or similar agricultural feedstock material. Either or both of reactors 1 and 2 may advantageously be configured as an upflow or downflow tube reactor, rather than a horizontal screw digester type reactor, commonly used in wood pulp manufacture (which are expensive, difficult to seal, etc.). Reactor 1 may be sized to provide a retention time for the components therein, of at least 60 minutes, at least 90 minutes, no more than 4 hours, no more than 3 hours, or no more than 2.5 hours, such as 2 hours. The consistency of the material in reactor 1 may be similar to that in the low consistency pulping module (e.g., 4%). The loading of caustic present in reactor 1 may be similar to that in the low consistency pulping module (e.g., 4-12%, 5-12%, or 8-10% by weight of the corn stover or other agricultural residue or other agricultural feedstock). The temperature in reactor 1 may also be similar to that in the low consistency pulping module (e.g., 65° C.). FIG. 3 illustrates data for such a reactor 1, showing yield and percentage of NaOH consumed (e.g., relative to starting NaOH). As shown, if the retention time is too long, yield begins to drop, and consumption of NaOH increases, representing the transition between the extraction of the fast lignin (more easily extracted) and the slow lignin (more difficult to extract). As such, in an embodiment, the residence time is maintained at about 2 hours (e.g., the start of the inflection relative to yield, as shown in FIG. 3). The data in FIG. 3 was obtained with a caustic loading of 9% NaOH relative to the mass of the corn stover feedstock material present in reactor 1.

The material exiting from reactor 1 is then fed into a screw press, as shown in FIGS. 2A-2B, separating the pulp material from the black liquor. Such a step can be important to the overall process, as it removes dissolved lignin from the process, before introduction into the second reactor. By removing reaction products before introduction into reactor 2, the efficient use of caustic is significantly improved, allowing efficient removal of lignin and hemicellulose while minimizing damage to the pulp fibers. As noted above, the black liquor produced by the present process is significantly less toxic than produced in other processes that employ higher temperatures and/or pressures. The black liquor that is produced is sent to the black liquor tank, which can then be divided, with a portion recirculated to the low consistency pulping module and another portion sent to the lignin and hemicellulose separation module, e.g., as such stream includes significant fractions of lignin and hemicellulose (which color the liquor a dark brown color), which can be recovered for use as a value added product, incorporated into a barrier coating applied to paper surfaces, or disposed of internally in the overall system and process as a fuel source, etc. By way of example, about 25% of corn stover agricultural residue material may be recoverable as lignin and/or hemicellulose.

Figure 4:
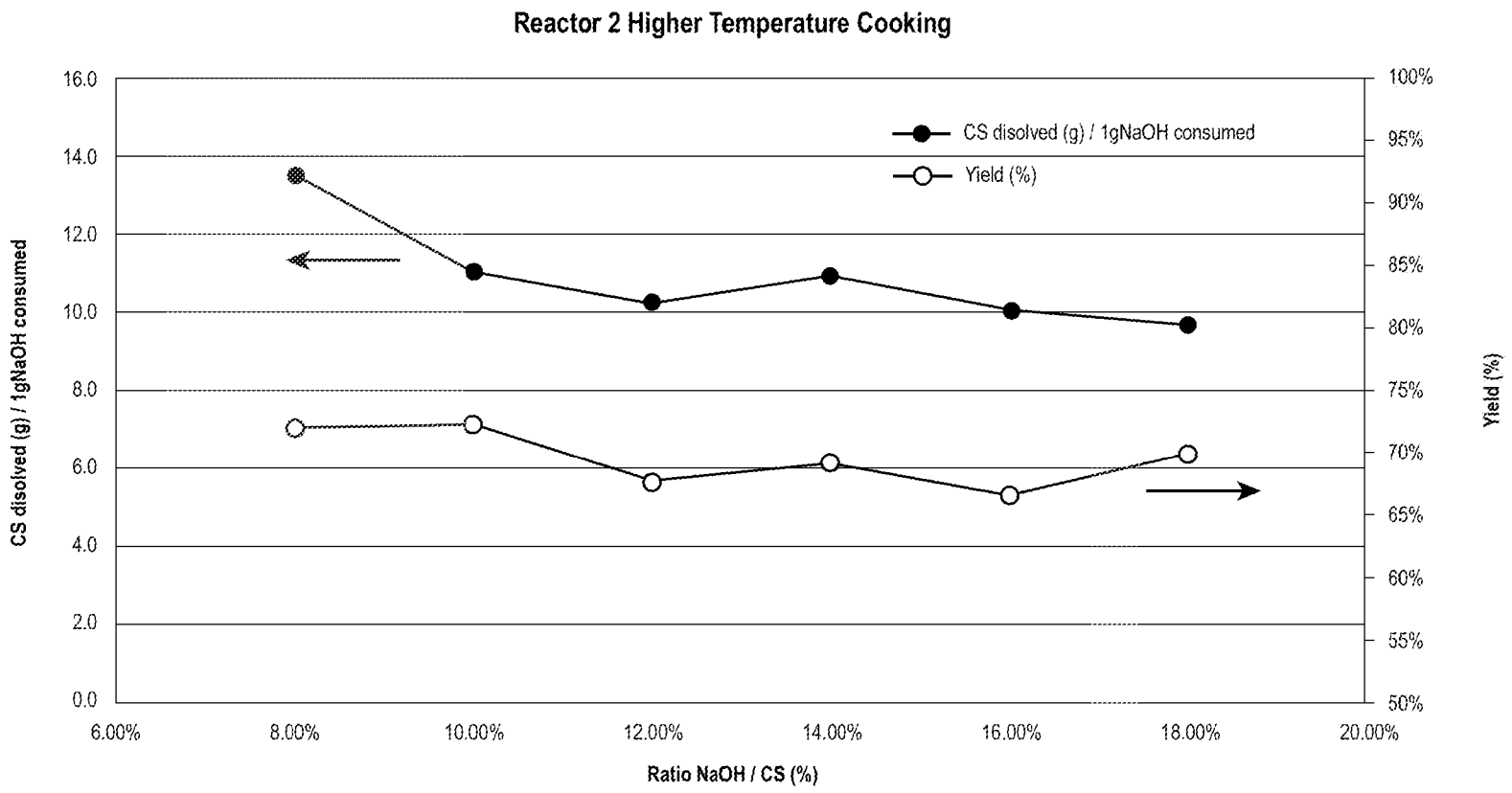
FIG. 4 shows the ratio of corn stover dissolved/g NaOH consumed, and yield, as a function of the ratio of NaOH to corn stover, at a reaction temperature of 113° C., exemplary of conditions in reactor 2, although the temperature in reactor 2 will more typically be about 95° C., rather than over 100° C.

Pulp exiting the screw press can be sent to a mixing conveyor, as shown in FIGS. 2A-2B. The screw press may operate at a consistency of 4% at the feed and a 30% consistency at the accept. More broadly, the accept may range from 10% to 50% consistency, or from 20% to 40% consistency. The mixing conveyor may receive white liquor from the lignin and hemicellulose separation module, and/or liquid from the chemiwasher, as shown in FIGS. 2A-2B. The accept consistency from the mixing conveyor may be about 5-6%, with dilution occurring principally from the liquid from the chemiwasher and the white liquor, as well as from fresh caustic that is added at this point, to adjust the caustic ratio to a higher value than in the low consistency pulping module or reactor 1. For example, the caustic ratio may be increased to a value of greater than 8%, or 10%, but less than 15%, such as 12%, at this point, for entry into reactor 2. Reactor 2 may be an upflow or downflow tube reactor, as is reactor 1. The retention time in reactor 2 may be less than that for reactor 1, e.g., about 90 minutes, but at higher temperature. As noted, the consistency of material in reactor 2 may be higher than in the previous modules, e.g., such as at a value of 5-6%. Temperature in reactor 2 may be higher than in reactor 1 and the low consistency pulping module, but still less than 100° C., such as from 90 to 99° C., or 92 to 96° C., 94° C. to 96° C., such as 95° C. FIG. 4 illustrates data from an exemplary reactor 2. FIG. 4 shows efficiency of the use of NaOH, as to how many grams of corn stover are dissolved or treated, per gram of NaOH consumed, at different caustic loading values. FIG. 4 also shows the effect of such factors on yield (grams of pulp produced divided by grams of corn stover feedstock fed into the system).

Although the data in FIG. 4 was obtained at a temperature of 113° C., it is advantageous for reactor 2 to operate at a temperature of less than 100° C., so as to minimize the generation of toxic byproducts in the black liquor, increase yield, increase efficient use of caustic, and to preserve fiber length and a freeness value in a range of 200 to 500 mL CSF, or 200 to 450 mL CSF, or 200 to 450 mL CSF, or 200 to 300 mL CSF. Material exiting reactor 2 is sent to the chemiwasher, where any black liquor can be countercurrent recycled back to the inlet of reactor 1, and/or the mixing conveyor, as shown. Pulp exiting the chemiwasher is ready for sending to the mixing conveyor and storage tank (e.g., at 3.5% consistency), where it may be subjected to coarse screening (e.g., to remove cob pieces or other coarse fractions), refining, fine screening, and dewatering modules of the paper machine system in which the pulp is eventually incorporated into paper products being produced on the paper machine. Additional details of how such integration may occur are disclosed in Applicant's Patent Application No. 63/194,345, filed May 28, 2021, entitled SYSTEM AND METHOD FOR REFINING AGRICULTURAL RESIDUES TO A PULP SPECIFICATION, and Applicant's patent application Ser. No. 17/825,964, filed May 26, 2022, entitled SYSTEM AND METHOD FOR REFINING AGRICULTURAL FIBERS TO A PULP SPECIFICATION, each of which is herein incorporated by reference in its entirety.

The first reactor may be agitated, while the $2^{nd}$ reactor may provide pulping without agitation. Such agitation is relatively gentle, e.g., consuming far less energy than the fibrillation/refining conducted in a lab blender as described in El Saied.

The coarse screening, refining, and/or fine screening modules may serve to fractionate the pulp materials, based on fiber length, or diameter. By way of example, refining may be achieved with a double disk refiner with low intensity refining plates, as will be appreciated by those of skill in the art. The coarse screening step may serve to separate that portion of the pulp that should be sent to the refiner. The small fraction passing through the coarse screen may not necessarily be fed into the refiner, as the small components do not need refining. Because corn stover and similar agricultural residue or other agricultural feedstock materials are not homogenous, as would be a wood feedstock, various different fiber lengths, as well as even non-fiber structures may be present in the pulp before fractionation. It may be desirable to remove some such structures, during screening, for example. For example, cobs are largely formed from nonfibrous material, including a large fraction of parenchyma cells, which appear rather as generally spherical or rounded particulates. Cobs may account for at least 10% by weight of the corn stover. In an embodiment, it would be advantageous to harvest corn stover in a way that would leave the cobs on the field. Where cob particulates (e.g., in the form of parenchyma cells) are included in the pulp material exiting the chemiwasher with the pulp, they can be separated from the pulp, as fines, using washing, if desired. Such materials can be added back into the pulp before introduction of pulp into the blend chest, to increase yield, if desired. By way of example, a given pulp product prepared from corn stover included a size distribution where 23% by weight of the material passed through a 200 mesh (75 micron opening) screen. Most if not all of these fines are believed to be parenchyma. In an embodiment, it may be beneficial to maintain such parenchyma in larger chunks (e.g., 10-20 parenchyma cells), rather than having them be present as fines, as individual parenchyma cells. Such may aid in increasing the freeness value, e.g., to greater than 300, or greater than 400 mL CSF.

Fractionation may be accomplished using horizontal slot baskets, which can allow passage of very long fibers (as corn stover fibers may be significantly longer than hardwood pulp fibers), providing fractionation based on fiber diameter, rather than fiber length. A 200 mesh wire thickener such as a double nip thickener (e.g., Kadant DNT) could be used to separate long fibers from the small parenchyma particulate fines.

While FIGS. 2A-2B illustrate module components for use in recovering lignin and hemicellulose, it will be appreciated that such steps are optional. That said, recovery of lignin and/or hemicellulose from the liquor fractions they are dissolved in can be a beneficial aspect of the present invention. By way of example, the black liquor may be filtrated, and the filtrate can be mixed under pressure with $CO_2$ (e.g., liquid $CO_2$) in a static mixer, to decrease pH. The lignin and hemicellulose will precipitate at low pH (e.g., pH of 3-5, such as 4), and can then be separated by filtration and/or centrifugation. The streams including the hemicellulose and lignin can be thickened by evaporation under vacuum, heating, or the like. The water from such processes may be condensed and reused. The white liquor can be processed in a tank to degas the $CO_2$ (e.g., by simple agitation to degas the $CO_2$) and increase the pH of the resulting liquid. The vented $CO_2$ can be processed in a $CO_2$ scrubber with a small portion of black liquor (at a higher pH). The final white liquor alkali content can be adjusted with NaOH, and sent to the mixing conveyor, as shown in FIGS. 2A-2B. If desired, hemicellulose can be extracted using ethanol, or another suitable medium for extraction. Alternative to $CO_2$, a weak acid, such as an organic acid (e.g., acetic acid) may be used to drop the pH and precipitate the lignin and/or hemicellulose. In an embodiment, no acids (particularly strong mineral acids, such as hydrochloric acid, sulfuric acid, nitric acid, or phosphoric acid) are used in producing the pulp.

FIG. 2B illustrates an exemplary process, very similar to that of FIG. 2A. A key difference between the processes of FIGS. 2A and 2B is that FIG. 2A shows packaging of the pulp product as wet lap bales, or dry bales of the prepared pulp product, while FIG. 2B shows conveyance (e.g., immediate conveyance) of the pulp product into the pulp chest of a paper making machine. It will be appreciated that the pulp product as produced by the present process may be packaged or otherwise prepared for use in a wide variety of downstream processes.

Traditional pulp mills use a high volume of water during pulp production, and as such typically require location near a natural water resource (e.g., on a river). The present systems as described do not require large volumes of water like a conventional pulp mill, so that such facilities as described herein can be located near a feedstock supply (where corn or other agricultural fibers are grown), and/or near an end user (e.g., a cardboard, molded product, or other manufacturer that would use such a pulp product). The present processes do not require significant process water, as they instead operate using a closed water loop, as illustrated in the Figures. Such a closed water loop, and overall simplified process allows pulp production from agricultural residues or other agricultural fibers at a cost that can be competitive to OCC.

In addition to kraft paper, liner, medium, and other similar products, the present non-wood pulp materials can also be used in the molding or thermoforming of molded pulp products, such as egg cartons, molded disposable "paper" plates, other food related containers, or various molded pulp products used for packaging consumer goods. Such molded pulp products are disposable single use products. Such molded pulp products have historically been formed from recycled newsprint, although the volume of available newsprint has drastically declined in recent years. Use of the present non-wood agricultural feedstock pulp materials can be used for molded pulp products, and will provide greater rigidity than comparable materials currently used in the manufacture of such products. For example, the agricultural fiber pulp can be introduced into a molded pulp product manufacturing machine (e.g., a pulp chest thereof) to make a molded pulp product from the agricultural fiber pulp. Such a process may include wet pressing and/or thermoforming. Another example product that can be formed using the present processes is cardboard tubes and cores (e.g., for rolls of toilet paper, rolls of paper towels, mailing tubes, as well as chipboard or grayboard (i.e., rigid container board). Such products may typically have a thickness from 0.5 mm to 5 mm.

It will also be appreciated that the present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A method for preparing agricultural materials as a feedstock for use as a pulp, the method comprising:

providing non-wood agricultural feedstock that includes agricultural fibers;

shredding, wetting, and conditioning the non-wood agricultural feedstock in a preliminary alkaline low consistency pulping module at a low consistency of from 1% to 10% at a low temperature to produce partially pulped agricultural fibers, such step including separating some lignin and hemicellulose from the partially pulped agricultural fibers;

introducing the partially pulped agricultural fibers into a first reactor, wherein the first reactor operates at a low temperature of less than 100° C.;

removing at least a portion of black liquor generated in the first reactor with a portion of the black liquor being recirculated to the preliminary alkaline low consistency pulping module, and a remainder being sent for recovery of hemicellulose and/or lignin therein; and introducing the partially pulped agricultural fibers from the first reactor into a second reactor, where the second reactor operates at a low temperature, of less than 100° C., the second reactor operating at a higher temperature than the first reactor, to produce pulped agricultural fibers;

wherein the preliminary alkaline low consistency pulping module operates at a temperature in a range of 40° C. to less than 100° C., and the preliminary alkaline low consistency pulping module has a residence time of less than 30 minutes.

2. The method of claim 1, wherein the pulped agricultural fibers are present as fiber bundles of a plurality of fibers.

3. The method of claim 1, wherein the pulped agricultural fibers are present as fiber bundles including 2 to 10 fibers.

4. The method of claim 1, wherein the non-wood agricultural feedstock comprises at least one of corn stover, hemp, wheat straw, rice straw, soybean residue, cotton residue, switchgrass, *Miscanthus*, DDGS, bamboo, or sugarcane bagasse.

5. The method of claim 1, wherein the non-wood agricultural feedstock is an agricultural residue that comprises corn stover.

6. The method of claim 1, wherein the first reactor operates at a temperature in a range of 40° C. to 80° C.

7. The method of claim 1, wherein the second reactor operates at a temperature in a range of 85° C. to 99° C.

8. The method of claim 1, wherein the preliminary alkaline low consistency pulping module operates at a temperature in a range of 40° C. to 80° C., and the preliminary alkaline low consistency pulping module has a residence time of less than 30 minutes.

9. The method of claim 1, wherein the first reactor operates at a temperature in a range of 40° C. to 80° C., and the first reactor has a residence time of 1 to 3 hours.

10. The method of claim 1, wherein the second reactor operates at a temperature in a range of 85° C. to 99° C., and the second reactor has a residence time of 30 minutes to 2 hours.

11. The method of claim 1, wherein the preliminary alkaline low consistency pulping module, the first reactor, and the second reactor operate at atmospheric pressure.

12. The method of claim 1, wherein the preliminary alkaline low consistency pulping module and the first reactor operate at a consistency of less than 5%.

13. The method of claim 12, wherein the second reactor operates at a consistency of at least 5%.

14. The method of claim 1, wherein the preliminary alkaline low consistency pulping module and the first reactor operate at a ratio of caustic to air dried non-wood agricultural feedstock that is from 4% to 12%.

15. The method of claim 14, wherein the second reactor operates at a weight ratio of caustic to non-wood agricultural feedstock that is from 8% to 15%.

16. The method of claim 1, wherein a yield of the pulped agricultural fibers as compared to the non-wood agricultural fibers introduced to the preliminary alkaline low consistency pulping module is at least 40% by weight.

17. The method of claim 1, wherein removing at least a portion of black liquor generated in the first reactor is accomplished with a screw press.

18. The method of claim 1, wherein the pulped agricultural fibers are produced without the use of ozone or addition of acids.

19. The method of claim 1, wherein the preliminary alkaline low consistency pulping module and the first reactor operate at a weight ratio of caustic to air dried non-wood agricultural feedstock that is from 5% to 12%.

20. The method of claim 1, wherein a yield of the pulped agricultural fibers as compared to the agricultural fibers introduced to the preliminary alkaline low consistency pulping module is at least 50% by weight.

21. The method of claim 1, wherein the pulped agricultural fibers are produced without the use of bleach.

22. The method of claim 1, wherein the method is a continuous process.

23. The method of claim 1, wherein a portion of the black liquor recirculated to the preliminary alkaline low consistency pulping module is sent to the second reactor before being recirculated to the preliminary alkaline low consistency pulping module.

24. A method for preparing agricultural materials as a feedstock for use as a pulp, the method comprising:

providing non-wood agricultural feedstock that includes agricultural fibers;

shredding, wetting, and conditioning the non-wood agricultural feedstock in a preliminary alkaline low consistency pulping module at a low consistency of from 1% to 10% at a low temperature to produce partially pulped agricultural fibers, such step including separating some lignin and hemicellulose from the partially pulped agricultural fibers;

introducing the partially pulped agricultural fibers into a first reactor, wherein the first reactor operates at a low temperature of less than 100° C.;

removing at least a portion of black liquor generated in the first reactor with a portion of the black liquor being recirculated to the preliminary alkaline low consistency pulping module, and a remainder being sent for recovery of hemicellulose and/or lignin therein; and introducing the partially pulped agricultural fibers from the first reactor into a second reactor, where the second reactor operates at a low temperature, of less than 100° C., the second reactor operating at a higher temperature than the first reactor, to produce pulped agricultural fibers;

wherein the second reactor operates at a weight ratio of caustic to non-wood agricultural feedstock that is from 8% to 15%.

25. The method of claim 24, wherein the non-wood agricultural feedstock comprises at least one of corn stover, hemp, wheat straw, rice straw, soybean residue, cotton residue, switchgrass, *Miscanthus*, DDGS, bamboo, or sugarcane bagasse.

26. The method of claim 24, wherein the non-wood agricultural feedstock is an agricultural residue that comprises corn stover.

* * * * *